United States Patent [19]

Robertson et al.

[11] 3,941,347

[45] Mar. 2, 1976

[54] COMPOSITE CONCRETE AND STEEL PALLET FOR FORMING ONE END OF CONCRETE PIPE

[75] Inventors: Harry H. Robertson, San Pedro; Donnie H. Hicks, Huntington Beach; Hugh M. Hofmann, La Habra, all of Calif.

[73] Assignee: Ameron, Inc., Monterey Park, Calif.

[22] Filed: Nov. 6, 1974

[21] Appl. No.: 521,351

[52] U.S. Cl. ..... 249/204; 249/100

[51] Int. Cl.[2] ..... B28B 21/02

[58] Field of Search ..... 425/DIG. 17, 262, 470; 249/100, 144, 146–148, 150, 152–153, 187–188, 204; 52/245, 247

[56] References Cited

UNITED STATES PATENTS

| | | | |
|---|---|---|---|
| 2,683,912 | 7/1954 | Serrell | 249/150 |
| 2,966,713 | 1/1961 | Billner | 249/100 |
| 3,180,000 | 4/1965 | Bossner | 249/152 |
| 3,186,679 | 6/1965 | Williams | 249/134 |

*Primary Examiner*—Robert D. Baldwin
*Assistant Examiner*—John McQuade
*Attorney, Agent, or Firm*—Christie, Parker & Hale

[57] ABSTRACT

A composite pallet for forming the lower end of a concrete pipe cast in a vertical position includes a concrete base having an annular portion shaped to form the end of the pipe. An outer annular steel ring is bonded to the base around the outer periphery of the annular portion of the concrete base, and an inner annular steel ring is bonded to the base around the inner periphery of the annular portion. The two rings are more chip-resistant than the concrete base. The outer ring is shaped to receive one end of an outer cylindrical form, and the inner ring is shaped to receive one end of an inner cylindrical form so that an annular cavity is formed between the two cylindrical forms for casting the concrete pipe.

5 Claims, 3 Drawing Figures

COMPOSITE CONCRETE AND STEEL PALLET FOR FORMING ONE END OF CONCRETE PIPE

BACKGROUND OF THE INVENTION

1. Field of the Invention

This invention relates to apparatus for making concrete pipe.

2. Description of the Prior Art

It has long been industrial practice to make concrete pipe by casting a concrete mixture or slurry in a mold cavity of suitable shape. U.S. Pat. No. 1,591,060 shows apparatus for making such pipe. Typically, a pair of cylindrical forms are mounted coaxially on a horizontal steel base, and the pipe is cast in the annular space beteen the two cylindrical forms.

A steel base is expensive because of the high cost of steel and the high cost of working it. In relatively large plants for making concrete pipe, the steel bases alone require a substantial capital investment. This invention provides a base which is relatively inexpensive compared to the prior art steel bases, and yet performs as well as the steel bases.

SUMMARY OF THE INVENTION

This invention provides a composite base or pallet for forming the lower end of a concrete pipe cast in an upright position. The pallet includes a concrete base having an annular portion shaped to form the lower end of the pipe. An outer annular ring is bonded to the base around the outer periphery of the annular portion of the base. An inner annular ring is bonded to the base around the inner periphery of the annular portion of the base. The two rings are each of a material which is more chip-resistant than the concrete base. Preferably, the rings are made of steel. The outer ring is shaped to receive one end of an upright outer cylindrical form, and the inner ring is shaped to receive one end of an upright inner cylindrical form, which fits coaxially within the outer form.

Preferably, the concrete base is annular, and the rings are embedded with lugs in the concrete.

In the preferred form, an annular boss is formed on the inner periphery of the outer ring to provide an outwardly extending annular shoulder or seat for the lower end of the outer form. An annular boss is formed on the outer periphery of the inner ring to provide an inwardly extending annular seat for the lower end of the inner cylindrical form.

DESCRIPTION OF THE PREFERRED EMBODIMENTS

Figure 1:
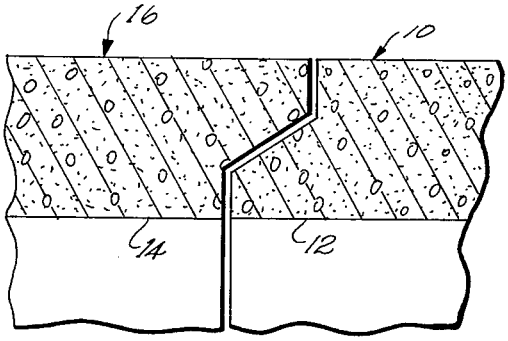
FIG. 1 is a fragmentary cross-sectional view showing typical bell and spigot ends of concrete pipes.

Referring to FIG. 1, a first section of pipe 10 includes the typical spigot end 12 adapted to mate with a typical bell end 14 of a second section of concrete pipe 16.

Figure 2:
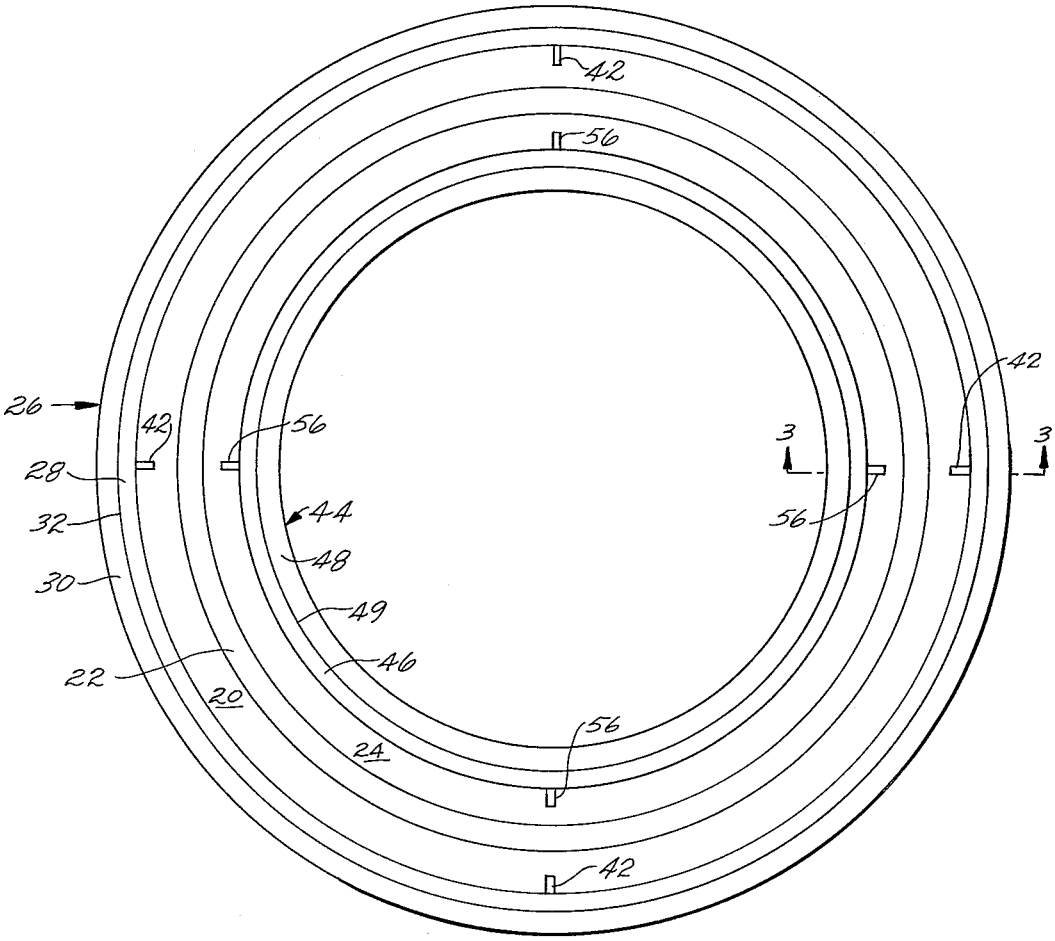
FIG. 2 is a plan view of the composite pallet of this invention with the outer and inner cylindrical forms removed.
Figure 3:
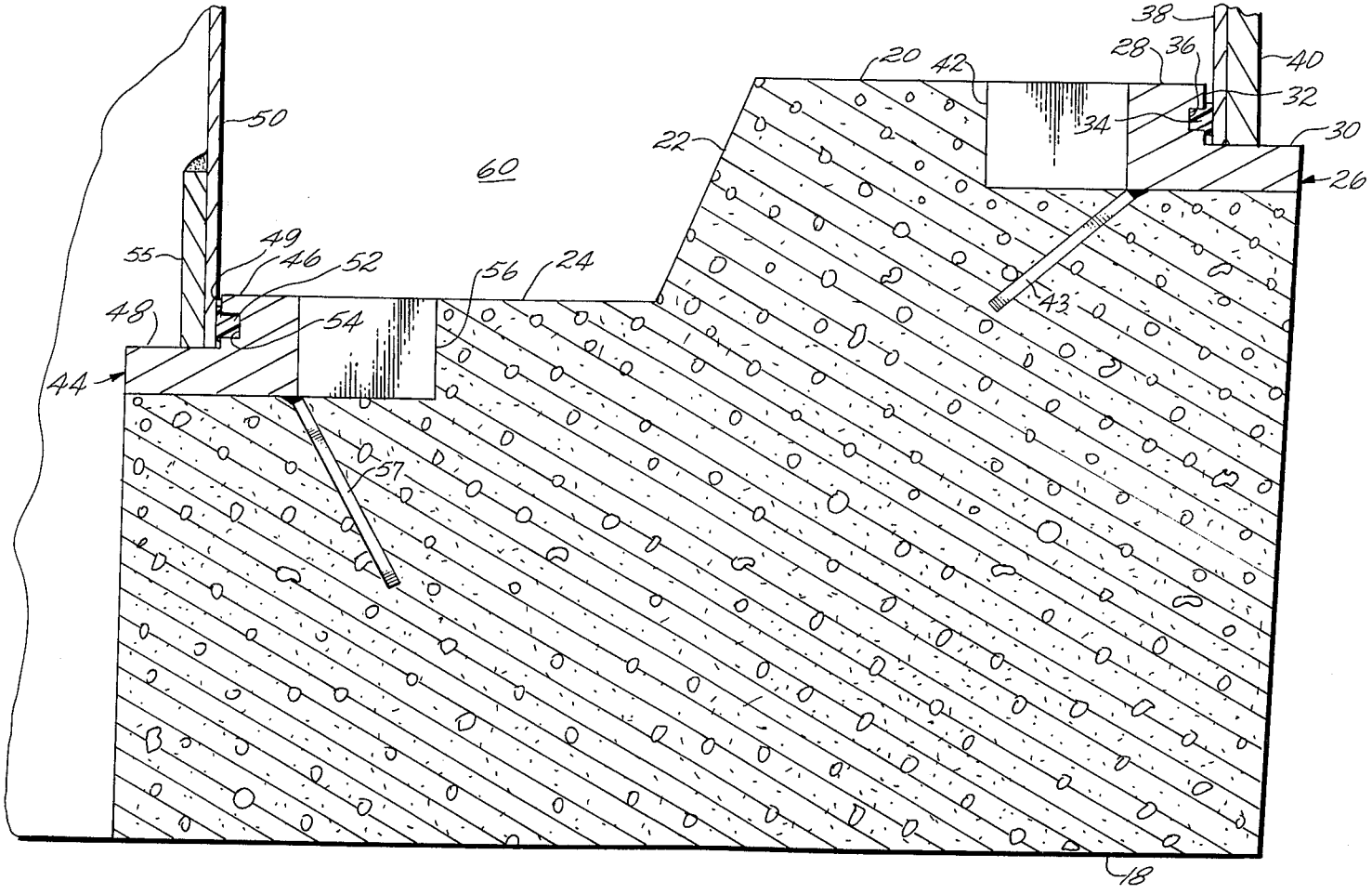
FIG. 3 is a view taken on line 3—3 of FIG. 2 with the outer and inner cylindrical forms in place for casting.

Referring to FIGS. 2 and 3, an annular concrete base 18 rests on a floor (not shown) or other suitable support. A raised annular boss 20 is formed integrally with the concrete base on its upper surface. A downwardly and inwardly sloping frusto-conical wall 22 joins the inner periphery of the concrete boss with the outer periphery of a lower flat central section 24, which forms the remainder of the top surface of the annular concrete base. A horizontal annular outer steel ring 26 is embedded in the upper edge of the outer periphery of the raised annular boss of the concrete base. The outer ring includes an upwardly extending annular boss 28 formed integrally with the remainder of the ring so that the ring has an annular outwardly extending shoulder or seat 30 and a vertical cylindrical wall 32. An annular gasket 34 is disposed within an outwardly opening horizontal annular groove 36 in the cylindrical wall 32 of the raised boss on the outer steel ring.

The lower end of a conventional hollow cylindrical form 38 makes a close fit against the vertical cylindrical wall 32. The gasket 36 seals the annular space between the inner face of the outer form and the upright cylindrical wall 32. The lower end of the outer form is stiffened by a relatively short heavy cylindrical outer shoe 40 welded to the outside surface of the outer form.

The outer ring is firmly anchored in the raised concrete boss by a plurality of inwardly and radially extending embedment lugs 42 welded at equally spaced intervals to the inside face of the outer ring, and by a plurality of inwardly and downwardly extending short sections 43 of reinforcing bar welded at their respective upper ends to the lower end of the junction between the lugs and the inner annular steel ring. Each lug is a vertical rectangular steel plate having a height equal to that of the outer ring. The upper surface of each lug is flush with the top surface of the raised boss on the outer ring, and both of these surfaces are flush with the top surface of the raised boss 20 on the concrete base.

A horizontal inner annular steel ring 44 is embedded in the inner periphery of the upper inner edge of the concrete base. The inner ring includes an integrally formed annular raised boss 46 on the outer periphery of the outer ring so that an inwardly extending annular seat 48 and a vertical cylindrical wall 49 are formed at the inner periphery of the inner annular ring. The lower end of an inner cylindrical form 50 rests on the inwardly extending seat 48. The outer surface of the inner form makes a close fit against the vertical cylindrical wall 49. An annular gasket 52 in an annular inwardly opening horizontal groove 54 in the vertical cylindrical wall 49 seals the annular space between the lower end of the inner form and the cylindrical wall 49. The lower end of the inner form is stiffened by a relatively short heavy cylindrical inner shoe 55 welded to the inside of the inner form.

The inner ring is firmly anchored in the concrete base by a plurality of radially and outwardly extending embedment lugs 56 welded at their respective inner ends to the outer face of the inner ring at equally spaced intervals, and a plurality of downwardly and outwardly extending short sections 57 of reinforcing bar welded at their respective upper ends to the lower end of the junction between the lugs and the outer annular steel ring. Each embedment lug is a vertical rectangular plate having a height equal to that of the total height of the inner ring so that the top surface of the raised boss on the inner ring, the top surface of each respective lug, and the horizontal surface 24 of the inner portion of the cylindrical base lie in the same horizontal plane. Thus, the upper surfaces of the rings, the lugs, and the concrete base are disposed to shape the spigot end of a concrete pipe (not shown in FIGS. 2 and 3) cast in the annular space 60 between the inner and outer forms.

In using the composite pallet of this invention, the top surface of the concrete base is coated with a suitable silicone base sealer which fills the surface pores of the concrete and reduces sticking of the cast concrete pipe to the concrete base. A wax coating is preferably applied on top of the silicone sealer between each casting operation to minimize sticking. The pallet and forms are assembled as shown in FIG. 3. Concrete mixture or slurry (not shown) is poured into the annular space between the inner and outer forms with suitable tamping and vibration. The upper end of the concrete pipe is shaped with a conventional top ring (not shown) to form the spigot end of the pipe. Of course, the pallet could be shaped so that it forms the spigot end of the pipe. This would be achieved by making a pallet which is the mirror image of the pallet shown in FIG. 3.

After the concrete mixture or slurry is sufficiently set for the pipe to be self-supporting, the cylindrical forms are removed, and are ready for reuse. After the pipe is more fully cured, it is removed from the pallet, which is then ready for cleaning and the application of a fresh coat of wax or oil before the next pipe is cast.

The advantages of this invention, particularly for large diameter pipes, say, three feet to twelve feet, is that the composite pallet results in significant material cost savings and substantially cuts fabricating costs. The bulk of the pallet is formed of concrete, which is relatively inexpensive, and easily cast in the desired shape. The steel rings on the pallet prevent spalling damage to the concrete base which would otherwise result from the repeated set-up and removal of the steel wall forms. The rings also provide a positive and reliable seal for both the inner and outer pipe wall forms.

We claim:

1. A composite pallet for forming one end of a cast concrete pipe, the pallet comprising a concrete base having an annular portion shaped to form the end of the pipe, an outer annular ring bonded to the base around the outer periphery of the annular portion, and an inner annular ring bonded to the base around the inner periphery of the annular portion, the two rings each being spaced from each other and of a material more chip-resistant than the concrete base, the outer ring being shaped to receive one end of an outer cylindrical form, the inner ring being shaped to receive one end of an inner cylindrical form.

2. Apparatus according to claim 1 in which the concrete base is annular.

3. Apparatus according to claim 1 in which the rings are made of steel.

4. Apparatus according to claim 1 in which an annular boss is formed on the inner periphery of the outer ring to receive the end of the outer form, and an annular boss is formed on the outer periphery of the inner ring to receive the end of the inner form.

5. Apparatus according to claim 4 which includes an outwardly opening annular groove around the annular boss on the outer ring, a gasket disposed in the groove in the outer ring to seal against the end of the outer form, an inwardly opening annular groove around the annular boss on the inner ring, and a gasket disposed within the groove around the annular boss on the inner ring to seal against the end of the inner form.

* * * * *